US005542365A

United States Patent [19]

Jurisich et al.

[11] Patent Number: 5,542,365

[45] Date of Patent: Aug. 6, 1996

[54] SHIP HAVING A CRUSHABLE, ENERGY ABSORBING HULL ASSEMBLY

[76] Inventors: Peter L. Jurisich, 1541--19th St., Manhattan Beach, Calif. 90267-1063; Theodore A. Achtarides, Elmwood Plantation E1, 6805 Veterans Blvd., Metairie, La. 70003

[21] Appl. No.: 362,211

[22] Filed: Dec. 22, 1994

[51] Int. Cl.[6] ..... B63B 3/14

[52] U.S. Cl. ..... 114/65 R; 188/377

[58] Field of Search ..... 114/13, 219, 65 R, 114/74 A; 188/371, 377; 293/132, 133

[56] References Cited

U.S. PATENT DOCUMENTS

| | | | |
|---|---|---|---|
| 1,294,920 | 2/1919 | Lemiszczak | 114/13 |
| 3,157,147 | 11/1964 | Ludwig . | |
| 3,412,628 | 11/1968 | DeGain | 188/377 |
| 3,482,653 | 12/1969 | Maki et al. | 293/133 X |
| 3,633,934 | 1/1972 | Wilfert | 293/133 |
| 3,888,531 | 6/1975 | Straza et al. | 293/132 |
| 4,023,652 | 5/1977 | Torke | 188/377 |
| 4,128,070 | 12/1978 | Shadid et al. | 114/74 A |
| 4,227,272 | 10/1980 | Masters | 114/65 R |
| 4,233,921 | 11/1980 | Torroja et al. | 114/74 R |
| 4,254,727 | 3/1981 | Moeller | 114/65 R |
| 4,548,154 | 10/1985 | Murata et al. | 114/355 |
| 4,890,877 | 1/1990 | Ashtiani-zarandi et al. | 188/371 X |
| 5,189,975 | 3/1993 | Zednik et al. | 114/74 A |
| 5,218,919 | 6/1993 | Krulikowski et al. | 114/74 A |

FOREIGN PATENT DOCUMENTS 57-26075 2/1982 Japan .

1043065 9/1983 U.S.S.R. .

*Primary Examiner*—Sherman Basinger
*Attorney, Agent, or Firm*—Loeb & Loeb LLP

[57] ABSTRACT

An ocean vessel such as an oil tanker or other ship has a hull assembly comprised of a non-ship structurally active, energy absorbing arrangement disposed between spaced-apart inner and outer hulls. The energy absorbing arrangement crushes in controlled fashion in response to impact loads on the ship's hull, such as may result if the ship collides with another ship or is grounded on an object such as a rock or reef. The crushing of the energy absorbing assembly provides highly efficient energy absorption so as to reduce the penetration of the hull and thereby greatly reduce the likelihood that the contents of, for example, an oil tanker may be spilled. In a first embodiment, a plurality of tubes extending between and joined to the opposite inner and outer hulls at desired angles relative thereto are provided with corrugations, flutes or dimples to enable the tubes to crush in controlled fashion. In a second embodiment, the crushable energy absorbing arrangement is comprised of rows of multi-cap cylinders joined together end-to-end, with each cylinder being comprised of a stack of nesting rounded, hollow caps. In a further embodiment, the crushable arrangement is comprised of a honeycomb sandwich of metal honeycomb core portions interspersed with metal sheets between the inner and outer hulls. In a still further embodiment, the crushable arrangement comprises a honeycomb sandwich foam material between the inner and outer hulls. The various crushable arrangements can also be used with a single hull ship.

2 Claims, 5 Drawing Sheets

SHIP HAVING A CRUSHABLE, ENERGY ABSORBING HULL ASSEMBLY

BACKGROUND OF THE INVENTION

1. Field of the Invention

The present invention relates to ocean going ships such as tankers, and more particularly to ships having a double or other hull configuration designed to reduce the likelihood of penetration of the hull and spillage of the contents of the ship in the event that the hull strikes an object, such as may result from a collision or from striking an underwater object such as a reef.

2. History of the Prior Art

It is known to provide ocean going ships such as tankers with a special hull configuration to resist penetration of the hull. In the event that the ship inadvertently strikes an underwater object such as a reef or a rock, the presence of an outer hull spaced from an inner hull reduces the chances of penetration of the inner hull and spillage of the ship's contents. Such hull configurations also provide protection in the event of collisions or other types of impacts by objects. Double hull configurations are becoming more and more commonplace, with increasing environmental concerns over the spillage of oil or other potential pollutants into the water.

In a typical double hull configuration for an ocean going ship, an outer hull surrounds and is spaced apart from an inner hull, with a plurality of unidirectional webs or other conventional bidirectional structural members extending between and coupling the two hulls together. Typically, longitudinal, and sometimes transverse, webs are disposed between the inner and outer hulls. The webs are active structural strength members which serve to join and hold the inner and outer hulls in the desired spaced-apart relation. Unfortunately, such active structural strength members are typically incapable of absorbing much energy in the event that the outer hull strikes an object. Consequently, both hulls must typically be of relatively thick construction and well separated.

It is also known in the art to provide a variety of different energy absorbing structural configurations and structural strength devices for use with ships and other watercraft of various designs. Unfortunately, such energy absorbing configurations and devices, which also form active structural strength members, have heretofore been incorporated into hull configurations with limited success. This is due to the inherent inability of the active structural strength members to absorb sufficient amounts of impact energy.

Examples of prior art in this area of structurally active hull configurations include U.S. Pat. Nos. 4,233,921 of Torroja et al., 4,227,272 of Masters, 4,254,727 of Moeller, 4,548,154 of Murata et al., 5,189,975 of Zednik et al., 4,128,070 of Shadid et al., and 3,157,147 of Ludwig, as well as Soviet Union Patent No. 1043-065-A and Japanese Patent No. 57-26075.

Thus, while various structurally active energy and shock absorbing devices have been proposed for use with ships and various watercraft in General, it has heretofore been unknown to provide a hull configuration with impact or energy absorbing means of sufficient effectiveness. Such means should not be structurally active, so as to be capable of functioning in a highly effective manner to absorb impact energy. It would therefore be advantageous to provide an energy absorbing double hull configuration for a ship capable of absorbing impacts and other energy imparted to the outer hull in a highly efficient and effective manner while preventing damage to or penetration of the inner hull. Such configuration should be nonstructurally active in order to be crushable, and therefore highly energy absorbing, and would permit relatively closer disposition of the outer hull to the inner hull, too. Close disposition of the inner and outer hulls also reduces the loss of useful cargo capacity. At the same time, such a configuration should permit both hulls to be of relatively thinner scantlings than in its absence.

BRIEF DESCRIPTION OF THE INVENTION

Briefly stated, the present invention provides a ship having an energy absorbing hull assembly, including an inner hull, an outer hull surrounding the inner hull and forming a space therebetween, the structurally active member joining the two hulls together, and an energy absorbing arrangement disposed in the space between the inner hull and the outer hull. The energy absorbing arrangement, which is provided in addition to the usual ship strength structurally active webs or other members which join the two hulls together, and which is itself not structurally active, is designed to crush and collapse in controlled fashion in response to impact loads on the outer hull. The effectiveness of such arrangement in absorbing energy from impact loads imposed on the outer hull enables both hulls to be of thinner construction and to be spaced closer together than would otherwise be possible.

In a first embodiment of a hull assembly for a ship, in accordance with the invention, the inner hull has a given thickness and the outer hull, though still active as a structural strength member, has a thickness substantially less than the given thickness of the inner hull. Each of a plurality of energy absorbing, non-structurally active members comprises a sealed hollow member having opposite ends coupled to the inner hull and the outer hull. Each sealed hollow member is provided with corrugations, flutes or dimples therein along a portion of the length thereof, as required, to provide controlled crushing and collapse thereof in response to impact loads on the outer hull. Each sealed hollow member can also be filled with impact absorbing material to further enhance the energy absorbing properties thereof.

Each of the sealed hollow members may comprise a hollow cylinder having first and second end caps sealed to opposite first and second ends thereof, to provide such sealed hollow members with buoyancy in the event that the outer hull is penetrated. The hollow cylinder may be welded to the inner hull at the first end thereof and plug welded to the outer hull at the second end thereof.

The hollow cylinders may be coupled to the inner and outer hulls so as to form generally right angles therewith. However, some of the hollow cylinders may be angled in a forward direction relative to the bow of the ship so as to better absorb impact energy in a variety of directions of impacting of the ship's hull.

In a second embodiment of a hull assembly for a ship, in accordance with the invention, a plurality of multi-cap cylinders extend between and have opposite ends thereof coupled to the inner and outer hulls. The multi-cap cylinders are also arranged side-by-side in rows extending in the direction of the longitudinal axis of the ship, and are joined together such as by welding. Each multi-cap cylinder is formed from a stack of hollow, generally circular caps of like configuration and each having a plurality of corrugations in a top surface thereof. The multi-cap cylinders crush in controlled fashion in response to impacts producing forces in various directions, including forces at right angles to and at other angles to the central axis of the cylinder as well as forces in the direction of the cylinder axis. The multi-cap cylinders continue to support and absorb the forces until completely crushed, thereby maximizing the energy absorption and enabling the hull assembly to absorb the kinetic energy of impact so as to slow or stop the ship faster and with less depth of penetration of the hull structure.

A third embodiment of a hull assembly for a ship, in accordance with the invention, is like the second embodiment in that it has improved energy absorbing capabilities in all directions. In the third embodiment, a honeycomb sandwich is attached to the outer and inner hulls so as to fill the space therebetween. The honeycomb sandwich is comprised of alternating metal sheets and layers of honeycomb core joined together and to the opposite hulls such as by adhesive bonding or furnace brazing. This joins the metal sheets and honeycomb layers in a manner providing controlled crushing in virtually all directions of impact force, while at the same time sealing the multiple chambers of the layers of honeycomb core to provide buoyancy in the event the outer hull is penetrated.

In a fourth embodiment of a hull assembly for a ship, the energy absorbing arrangement is comprised of a honeycomb sandwich foam material arranged at desired orientations relative to the inner and outer hulls.

BRIEF DESCRIPTION OF THE DRAWINGS

A detailed description of the invention will be made with reference to the accompanying drawings, in which.

DETAILED DESCRIPTION

Figure 1:
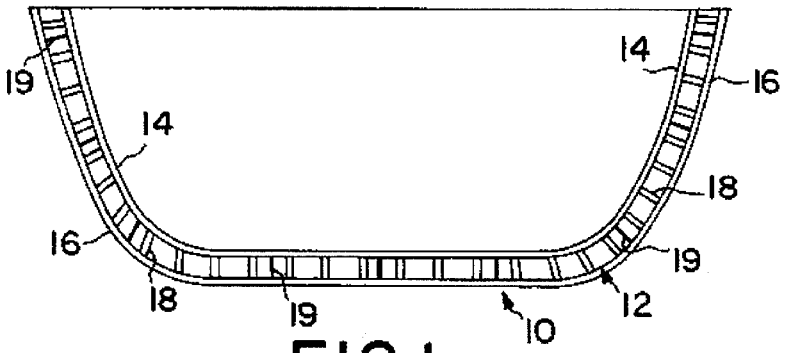
FIG. 1 is a sectional view of a ship's hull assembly having an energy absorbing double hull configuration in accordance with a first embodiment of the invention.

FIG. 1 shows a ship 10 having a hull assembly 12 in accordance with the invention. The hull assembly 12 is of double hull configuration and includes an inner hull 14 and an outer hull 16. The outer hull 16 is disposed outside of and surrounds the inner hull 14. The outer hull 16 is spaced apart from the inner hull 14 any way; it can therefore also accommodate a plurality of non-ship structural strength members therebetween. Such members are crushable, energy-absorbing members or tubes 18.

The tubes 18 are structurally inactive, and therefore crushable and energy absorbing, inasmuch as structurally active members in the form of unidirectional webs 19 extend between and connect the two hulls 14 and 16 together. Alternatively, other types of structurally active connectors such as conventional bidirectional stiffeners can be used. The type of structurally active members used is immaterial.

In the event that the ship 10 should be impacted as a result of a collision or by striking an object such as a reef or a rock, the outer hull 16 first engages the impacting object. In accordance with the invention, and as described in detail hereafter, the tubes 18 are designed to crush and collapse in controlled fashion so as to efficiently absorb the energy of impact of the outer hull 16 by the impacting object. Such energy absorption acts to preserve and prevent penetration of the inner hull 14. This is particularly desirable in cases where the ship 10 comprises an oil tanker or is otherwise designed to carry a substance which must be prevented from leaking, if at all possible, in the event that the hull assembly 12 strikes an impacting object.

Figure 2:
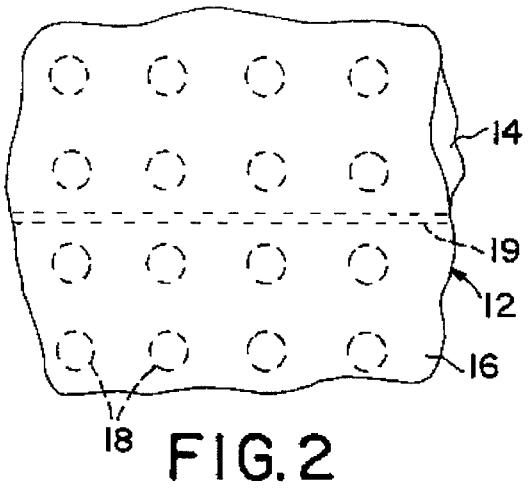
FIG. 2 is a side view of a portion of the hull assembly of FIG. 1.

FIG. 2 shows a portion of the hull assembly 12. As shown in FIG. 2, the tubes 18 are arranged in a generally uniform pattern of rows and columns, between the inner hull 14 and the outer hull 16. However, the tubes 18 can be arranged in any appropriate configuration, including various angles of inclination to the hulls as described hereafter, to provide the desired energy absorption so as to protect the inner hull 14.

Figure 3:
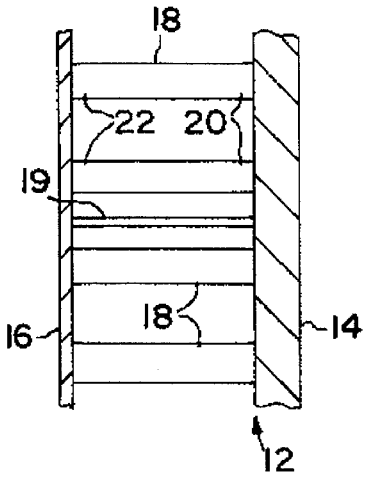
FIG. 3 is a sectional view of a portion of the hull assembly of FIG. 1.

FIG. 3 is a sectional view of a portion of the hull assembly 12 including the inner hull 14, the outer hull 16, a plurality of the tubes 18 and one of the webs 19. As described in connection with FIG. 4, each of the tubes 18 is of hollow, generally cylindrical configuration and is sealed at the opposite ends so as to provide a sealed tube. Each of the tubes 18 has a first end 20 coupled to the inner hull 14 and an opposite second end 22 coupled to the outer hull 16.

Figure 4:
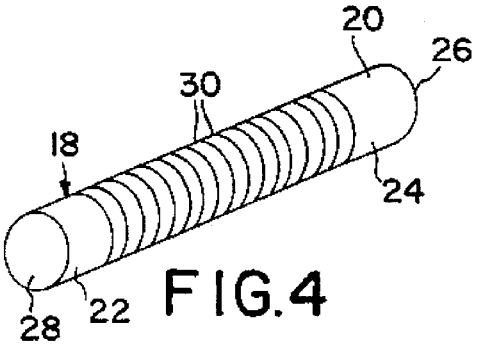
FIG. 4 is a perspective view of one of the hollow cylindrical tubes used in the hull assembly of FIG. 1.

FIG. 4 shows one of the tubes 18. As seen in FIG. 4, the tube 18 is comprised of a hollow cylindrical shell 24. A circular end cap 26 is sealed over the first end 20 of the tube 18, such as by welding to the open end of the shell 24. In similar fashion, a circular end cap 28 is sealed to the opposite second end 22 of the tube 18, such as by welding to the opposite open end of the shell 24. In this manner, the sealed tube 18 is formed. This is advantageous in that the sealed tubes 18 provide buoyancy in the event the outer hull 16 is penetrated.

In accordance with the invention, the tubes 18, being non-ship structural strength members, are designed to crush and collapse or otherwise deform in controlled fashion so as to absorb the energy of impacting of the outer hull 16 by a foreign object, in efficient fashion. As shown in FIG. 4, the tube 18 may be made to deform in controlled fashion by forming the cylindrical shell 24 with a plurality of annular corrugations 30 along a portion of the length of the tube 18. As discussed hereafter in connection with FIGS. 8 and 9, however, the tube 18 can be provided with other means for providing the controlled deformation thereof.

Figure 5:
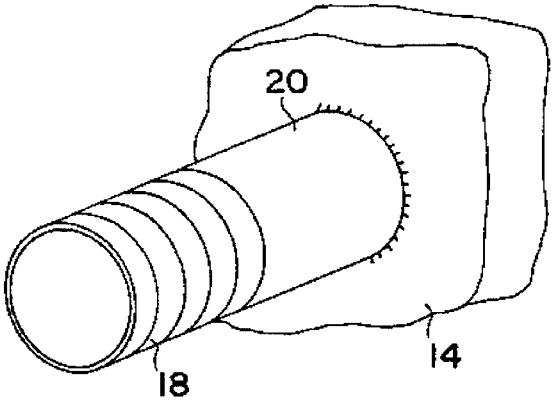
FIG. 5 is a perspective view of a portion of the tube of FIG. 4 showing the manner in which a first end thereof is coupled by welding to the inner hull.
Figure 6:
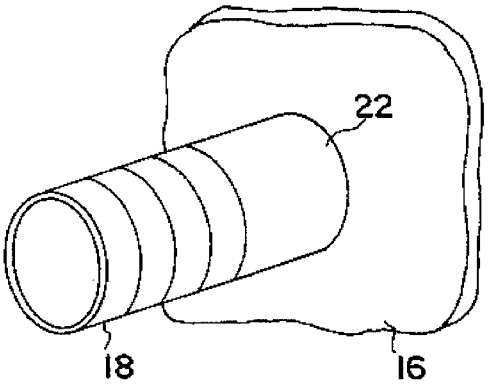
FIG. 6 is a perspective view of a portion of the tube of FIG. 4 showing the manner in which an opposite outer end thereof is coupled to the outer hull such as by plug welding.

As described in connection with FIG. 3, each of the tubes 18 is coupled at the first end 20 thereof to the inner hull 14. The first end 20 of each tube 18 is coupled to the inner hull 14 in a relatively sturdy and rigid manner. An example of such coupling is shown in FIG. 5, where the first end 20 of the tube 18 is welded to the surface of the inner hull 14 by welding around the circumference thereof. The tubes 18 are coupled to the outer hull 16 by a less substantial connection such as by plug welding when compared with the welding connection of the first end 20 to the inner hull 14. Such plug welding connection is shown in FIG. 6. Accordingly, the inner hull 14, with design-determined scantlings to resist overall and local ship structural loads during normal operations, is of further substantial construction and has a given design-determined thickness to also protect the contents of the ship locally in a better way. At the same time, while the outer hull also contributes in resisting overall as well as local structural loads during normal operation, nevertheless it can be of scantlings substantially less than those of the inner hull 14. The outer hull 16 therefore combines with the tube 18 to form part of an exterior energy absorbing crumple zone, in the event of an impact.

At the same time, the greatly enhanced energy absorbing capabilities of the tubes 18 and the manner in which they are disposed between and coupled to the inner and outer hulls 14 and 16 enables the inner and outer hulls 14 and 16 to be spaced considerably more closely together than in the case of typical prior art double hull configurations. This represents a saving in space and therefore in the cargo capacity of the ship, and in the materials required. The tubes 18 are simply spaced at various angles relative to each other and with a sufficient density to provide for the needed energy absorption.

Figure 7:
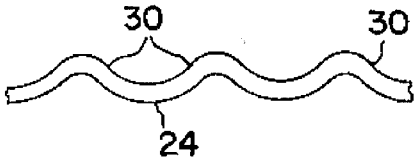
FIG. 7 is a sectional view of a portion of the tube of FIG. 4 showing the manner in which the tube may be corrugated to provided controlled collapsing thereof with improved energy absorption efficiency.

FIG. 7 is a cross-sectional view of a portion of the shell 24 which comprises the tube 18, showing the nature of the corrugations 30. The corrugations 30, which are annular in configuration, provide controlled crushing or crumpling of the tube 18 in response to impact energy applied to the outer hull 16 at the second end 22 of the tube 18.

Figure 8:
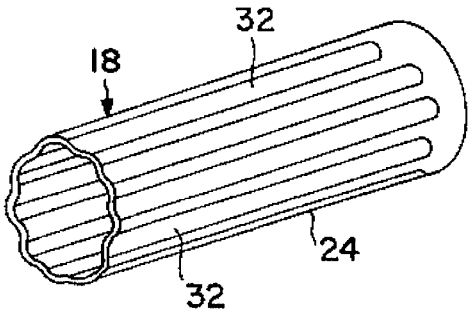
FIG. 8 is a perspective view of a portion of a tube similar to that of FIG. 4 but instead provided with a plurality of flutes along the length thereof to provide controlled collapsing thereof with improved energy absorption efficiency.

Alternatively, and as shown in FIG. 8, the tube 18 can be provided with controlled crushing or crumpling by forming the cylindrical shell 24 thereof so as to have a plurality of longitudinal flutes 32 extending along the length thereof. The flutes 32 function in a manner similar to the annular corrugations 30 to allow for controlled crushing or crumpling of the tube 18 in response to impact energy.

Figure 9:
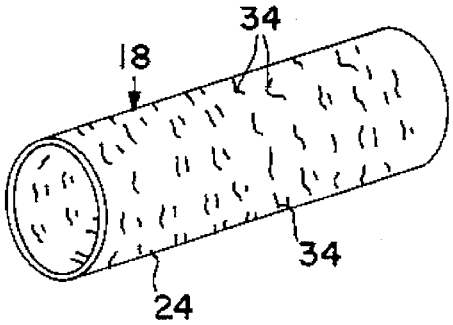
FIG. 9 is a perspective view of a portion of a tube similar to the tube of FIG. 4 but instead provided with a plurality of dimples therein to provide controlled collapsing thereof with improved energy absorption efficiency.

A further alternative arrangement of the tube 18 is shown in FIG. 9. As seen in FIG. 9, the cylindrical shell 24 is provided with a plurality of dimples 34 along a portion of the length of the tube 18. The dimples 34 act much in the same manner as do the longitudinal flutes 32 and the annular corrugations 30 to provide controlled crushing or crumpling of the tube 18 in response to impact loads at the outer second end 22 thereof.

Figure 10:
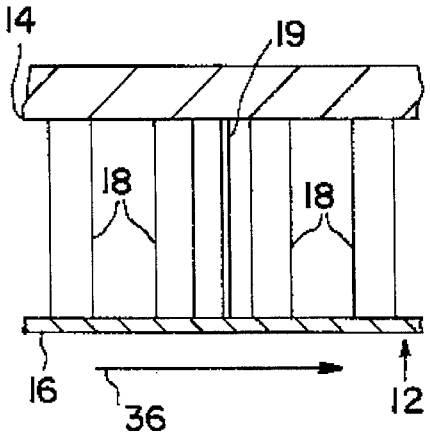
FIG. 10 is a sectional view of a portion of the hull assembly of FIG. 1 showing one design thereof in which the tubes therebetween form generally right angles with the inner and outer hulls.

FIG. 10 is a sectional view of a portion of the hull assembly 12. The sectional view of FIG. 10 is a top sectional view, inasmuch as the hull assembly 12 is assumed to be moving in a direction represented by an arrow 36. In the arrangement of FIG. 10, each of the tubes 18 is coupled to the inner and outer hulls 14 and 16 so as to be generally perpendicular or at right angles relative thereto. This enables the circular end caps 26 and 28 to be used at the opposite ends 20 and 22 of the cylindrical shell 24. The structurally active webs 19, which extend between and connect the two hulls 14 and 16 together, are also perpendicular to the hulls 14 and 16.

Figure 11:
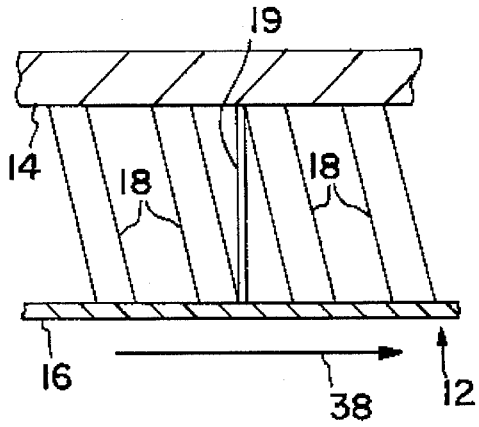
FIG. 11 is a sectional view of a portion of the hull assembly of FIG. 1 showing another design thereof in which some or all of the tubes are angled forwardly toward the bow of the ship.

FIG. 11 shows an alternative arrangement. In the alternative arrangement of FIG. 11, at least some of the tubes 18 including the ones shown are angled at other than 90° or right angles relative to the inner and outer hulls 14 and 16. In the arrangement of FIG. 11, the tubes 18 are angled in a forward direction toward the bow of the ship 10 as represented by an arrow 38 which, like the arrow 36 of FIG. 10, represents the direction in which the ship 10 is moving. The arrangement of FIG. 11 is preferred in some instances, because the tubes 18 are angled in the direction of movement of the ship 10 so as to better absorb impacts to the outer hull 16 from a variety of directions. Where desired, tubes can be provided which extend essentially along the length of the ship. In the case of FIG. 11, the opposite open ends of the cylindrical shell 24, which are angled, are sealed over by end caps of oblong configuration (not shown).

Figure 12:
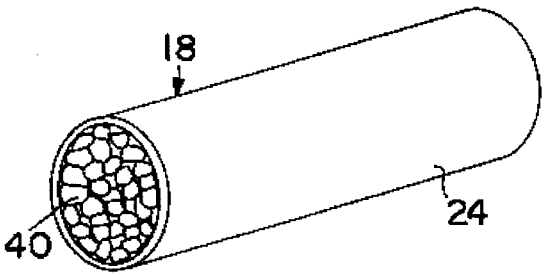
FIG. 12 is a sectional view of a portion of a tube showing the manner in which the hollow interior of the tubes of FIGS. 4, 8 and 9 can be filled with impact absorbing material.

In accordance with the invention, deformation of the tubes 18 can he further controlled and energy absorption enhanced by filling the hollow interior of the cylindrical shell 24 with an impact absorbing material 40, as shown in FIG. 12. The impact absorbing material 40 fills the hollow interior of the cylindrical shell 24 so as to assist in controlling the crushing of the tube 18. Examples of materials which may be used as the material 40 include foam materials, in honeycomb or other form, and similar materials.

The double hull configurations thus far described utilize different forms of the tubes 18 to absorb impact energy. The tubes 18 absorb the impact energy best when the forces of impact are in the direction of the longitudinal axes of the tubes 18 or at relatively small angles relative thereto. For this reasons, the tubes 18 are disposed between the hulls 14 and 16 in orientations chosen in accordance with the likely directions of impact forces, as previously described in connection with FIGS. 10 and 11. However, it is difficult to predict or anticipate the directions of the impact forces. The hull assembly may be subjected to various different collisions and impacts with objects, both above the water and beneath the water, each resulting in impact forces in different directions.

For this reason, it would be advantageous to provide the hull assembly 12 with a crushable arrangement capable of essentially omnidirectional energy absorption. Such arrangement must be capable of crushing in controlled fashion instead of completely collapsing in response to side loads and loads in directions other than perpendicular to the surface of the outer hull 16. Such arrangements must be capable of efficiently absorbing kinetic energy of the type produced by the forward motion of the ship when running aground, for example. By providing omnidirectional energy absorption by being capable of crushing in controlled fashion in various directions, the ship is stopped more quickly and at the same time the depth of penetration of the hull assembly is reduced. Examples of arrangements capable of omnidirectional energy absorption are described hereafter in connection with FIGS. 13–20.

Figure 13:
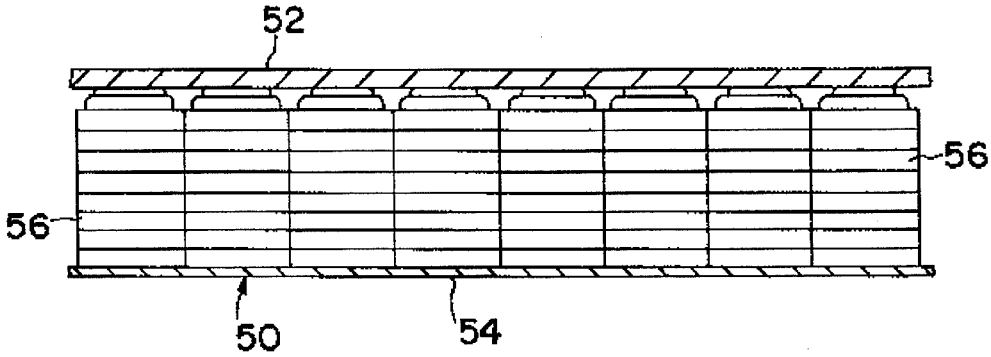
FIG. 13 is a sectional view of a second embodiment of an energy absorbing hull assembly in accordance with the invention, in which multi-cap cylinders are used.

FIG. 13 shows a hull assembly 50 comprised of an inner hull 52 and an outer hull 54. The hulls 52 and 54 may be constructed in a manner similar to the hulls 14 and 16 respectively of the arrangements of FIGS. 1–12, with the outer hull 54 being thinner than the inner hull 52. Also, the hulls 52 and 54 are connected by structurally active members, such as the unidirectional webs 19 previously shown and described with reference to FIGS. 1–12. However, such structurally active members are not shown in FIG. 13 or in subsequent figures, for ease of illustration.

The hull assembly 50 of FIG. 13 includes a plurality of multi-cap cylinders 56 extending between and coupled to the surfaces of the inner and outer hulls 52 and 54. The multi-cap cylinders 56, which are disposed so that the central axes thereof are generally perpendicular to the surfaces of the hulls 52 and 54, are arranged in side-by-side fashion in a plurality of spaced-apart rows extending generally along the length of the ship 10. A single row of the multi-cap cylinders 56 is shown in FIG. 13. Adjacent rows of the multi-cap cylinders 56, which are not shown in FIG. 13, are spaced apart from the row shown in FIG. 13. The spaces between the multi-cap cylinders 56 accommodate the structurally active members (not shown) and also provide access for inspection of the hull assembly 50.

Figure 14:
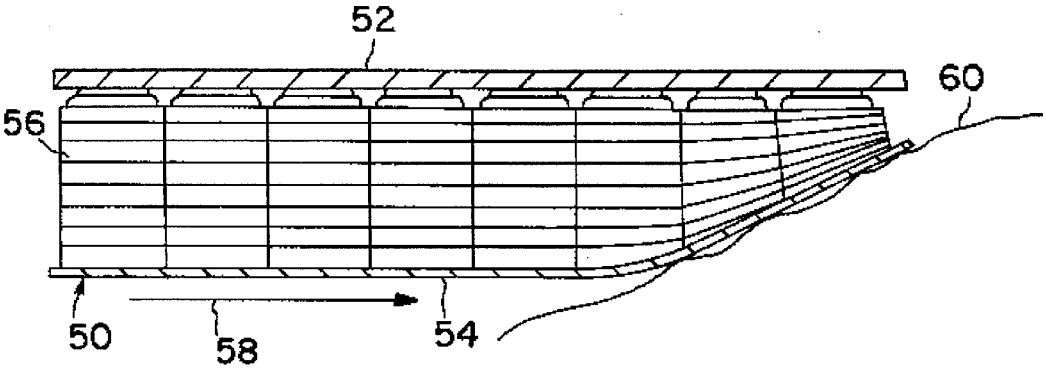
FIG. 14 is a sectional view similar to that of FIG. 13 and illustrating the manner in which the multi-cap cylinders crush in controlled fashion in response to impact forces in various directions.

The manner in which the multi-cap cylinders 56 of the hull assembly 50 of FIG. 13 provide omnidirectional energy absorption so as to be capable of absorbing impact forces in almost any direction in efficient and controlled fashion, is illustrated in FIG. 14. In FIG. 14, the ship is traveling in a direction shown by an arrow 58 and has run aground by striking a reef 60. The impact of striking the reef 60 results in forces being directed onto the hull assembly 50 in various different directions, most of which are diagonal to the axes of elongation of the multi-cap cylinders 56. Whereas the tubes previously described might also tend to buckle when subjected to side loading or side forces, in which case they will be capable of absorbing the impact energy for a shorter period of time before the buckling occurs, the multi-cap cylinders 56 continue to absorb the impact energy until they are almost entirely crushed. This enables absorption of the kinetic energy of forward motion of the ship, so that the ship is stopped much faster and the depth of penetration of the hull assembly 50 is reduced. The multi-cap cylinders 56 continue to absorb the impact forces until they are almost completely crushed. This maximizes the energy absorption.

Figure 15:
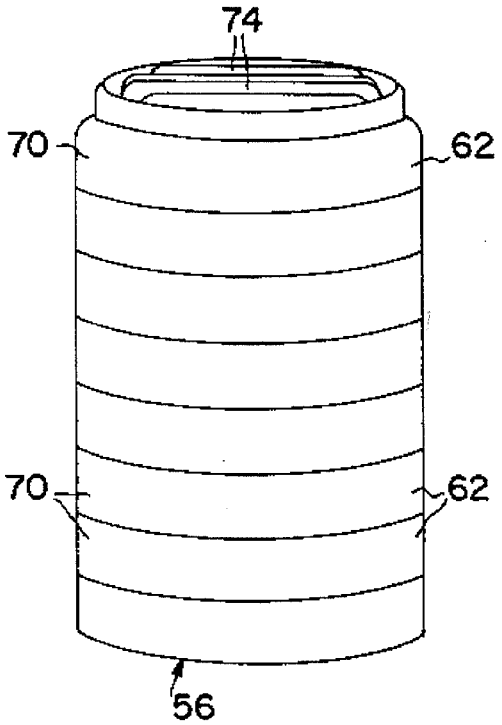
FIG. 15 is a prospective view of one of the multi-cap cylinders of the assembly of FIG. 13.
Figure 16:
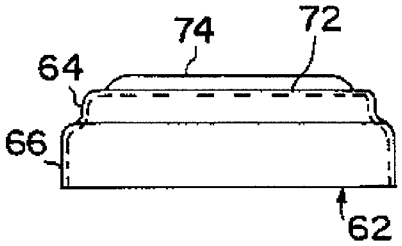
FIG. 16 is a front view of one of the caps of the multi-cap cylinder of FIG. 15.

FIG. 15 shows one of the multi-cap cylinders 56 of the hull assembly 50 of FIG. 13. As shown in FIG. 15, the multi-cap cylinder 56 is comprised of a stack of caps 62 of rounded, hollow configuration. The caps 62 are of like configuration. FIG. 16 is a front view of one of the caps 62, and FIG. 17 is a side view of the cap 62.

Figure 17:
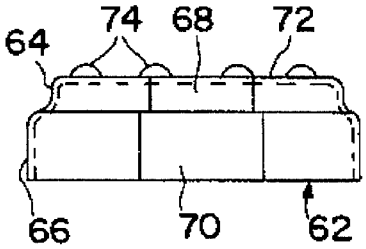
FIG. 17 is a side view of the cap of FIG. 16.

As shown in FIGS. 15–17, each cap 62 is comprised of a rounded upper portion 64 and a rounded lower portion 66 having a diameter greater than that of the upper portion 64. The upper portion 64 has relatively flat portions 68 on opposite sides thereof. The lower portion 66 has relatively flat portions 70 on opposite sides thereof, adjacent to the flat portions 68 of the upper portion 64. The flat portions 70 of the lower portion 66 abut the flat portions of caps of adjacent ones of the multi-cap cylinders 56 and are welded thereto to join the multi-cap cylinders 56 in side-by-side fashion in a row, as described hereafter in connection with FIG. 18.

The upper portion 64 of the cap 62 has a relatively flat top 72 with a plurality of corrugations 74 thereon. The corrugations 74 extend upwardly from the top 72, and in the case of the uppermost cap 62 of the multi-cap cylinder 56, provide a means of attachment of the upper end of the multi-cap cylinder 56 to the surface of the inner hull 52, such as by welding. The cap 62 at the opposite lower end of the multi-cap cylinder 56 is attached to the surface of the outer hull 54, such as by welding.

In the present example, the caps 62 are made of steel, and are formed such as by stamping. The caps 62 are approximately 3 feet in diameter, and have a thickness of approximately ⅛ inch. The upper portion 64 of smaller diameter enables the caps 62 to fit together in a nesting relationship when stacked together to form one of the multi-cap cylinders 56. The upper portion 64 of each of the caps 62, except for the topmost cap in the multi-cap cylinder, resides within the lower portion 66 of the immediately above cap 62. Adjacent caps 62 are joined together, such as by furnace brazing or welding, to form each multi-cap cylinder 56. The diameters, metal thickness and modulus of elasticity of the caps 62 are chosen to optimize the crushing and energy absorbing capabilities of the multi-cap cylinders 56 when subjected to impact forces in various directions.

Figure 18:
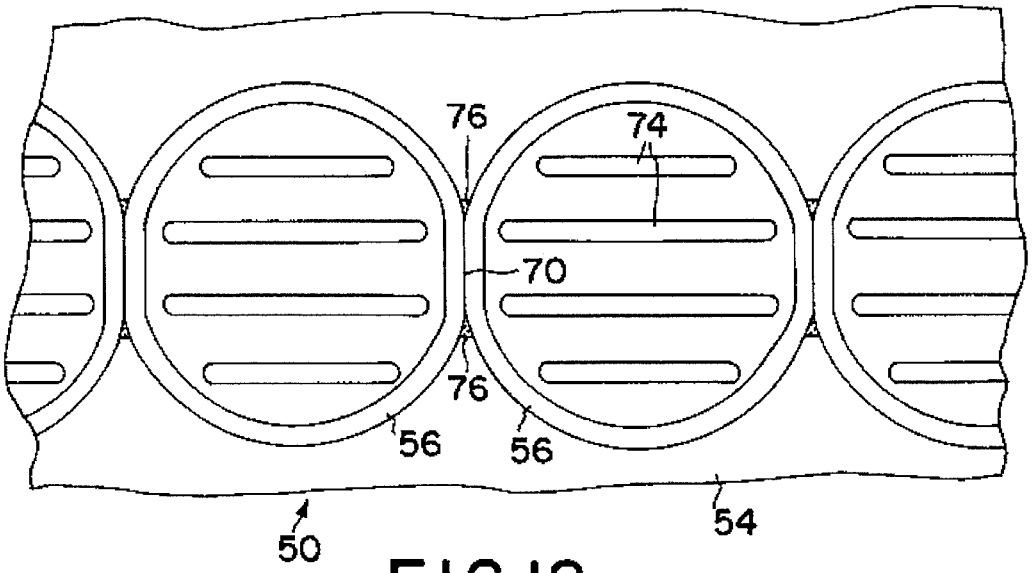
FIG. 18 is a top view of a portion of a row of the multi-cap cylinders of the assembly of FIG. 13, showing the manner in which the multi-cap cylinders in the row are joined together in side-by-side fashion.

FIG. 18 shows a portion of a row of the multi-cap cylinders 56 disposed in side-by-side fashion. FIG. 18 is a top view of a portion of the hull assembly 50, with the inner hull 52 removed in order to show the multi-cap cylinders 56. Adjacent ones of the multi-cap cylinders 56 are disposed so that the flat portions 70 of the caps 62 thereof abut one another. The adjacent multi-cap cylinders 56 are joined to each other, such as by welding. As shown in FIG. 18, welding seams 76 are formed along opposite sides of the flat portions 70, to join the adjacent multi-cap cylinders 56.

Figure 19:
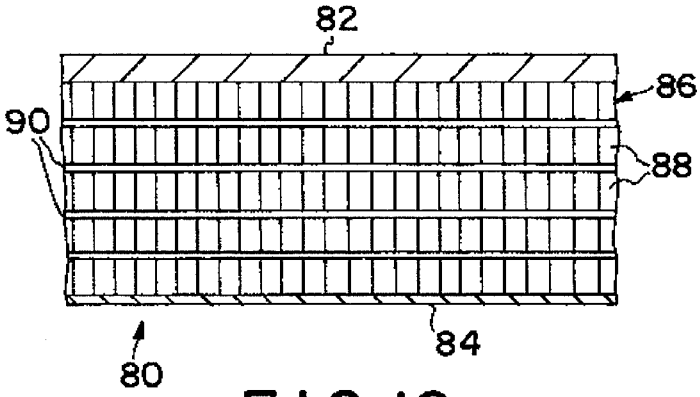
FIG. 19 is a sectional view of a third embodiment of an energy absorbing hull assembly in accordance with the invention, in which a honeycomb sandwich is used.
Figure 20:
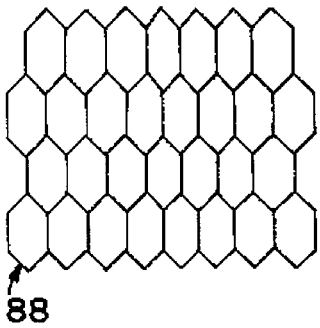
FIG. 20 is a top view of one of the layers of honeycomb core of the assembly of FIG. 19.

A further example of a double hull configuration having omnidirectional energy absorbing capabilities is shown in FIGS. 19 and 20. As shown in FIG. 19, a hull assembly 80 includes an inner hull 82 of given thickness and an opposite outer hull 84 which is thinner than the inner hull 82 as in the case of the embodiments previously described. A honeycomb sandwich 86, disposed between the inner and outer hulls 82 and 84, is comprised of an alternating stack of honeycomb core portions 88 and thin metal sheets 90. The honeycomb core portions 88 are of generally uniform thickness and are made of metal. An uppermost one of the honeycomb core portions 88 is joined such as by welding to the surface of the inner hull 82. An opposite, lowermost honeycomb core portion 88 is joined to the outer hull 84, such as by welding. In between, the honeycomb core portions 88 and the thin metal sheets 90 are welded together to form the continuous, integral honeycomb sandwich 86. The honeycomb sandwich 86 is positioned between the opposite hulls 82 and 84, in between the structurally active members which, as in the case of FIG. 13, are omitted from FIG. 19 for ease of illustration.

FIG. 20 is a top view of one of the honeycomb core portions 88. As shown in FIG. 20, the metal elements comprising the honeycomb core portion 88 are arranged to provide a series of hexagonal cells, in typical honeycomb fashion. The sizes and metal thicknesses of the honeycomb core portions 88 and the thin metal sheets 90 are chosen to provide the honeycomb sandwich 86 with a controlled crushing characteristic. As a result, the honeycomb sandwich 86 responds to impact forces exerted on the hull assembly 80 in various different directions by crushing in controlled fashion. The forces are supported until the honeycomb sandwich 86 is completely crushed, thereby maximizing the energy absorption, essentially in the same manner as in the case of the embodiment of FIGS. 13–18.

It should be understood by those skilled in the art that the foregoing embodiments shown and described are merely examples of double hull configurations in accordance with the invention, and that other configurations are possible. For example, and in accordance with a fourth embodiment, a sandwich of honeycomb foam material can be used as the energy absorbing arrangement instead of the honeycomb sandwich 86 of FIGS. 19 and 20. The honeycomb foam sandwich can be arranged at any desired orientations relative to the inner and outer hulls, and provides buoyancy by virtue of its nature. The honeycomb sandwich 86 of FIGS. 19 and 20 also provides buoyancy, inasmuch as the individual cells of each honeycomb core portion 88 are sealed upon welding of such portion to the adjacent thin metal sheets 90.

In accordance with further alternative embodiments and configurations, a single-hull ship can be "padded" with assemblies and materials of the type previously described in connection with double hull embodiments. In such instances, the material is not used to form structurally active components of the ship and serves no particular function during normal operation. In the event of a collision, however, such material is crushable and disposable so as to efficiently absorb the impact energy.

Figure 21:
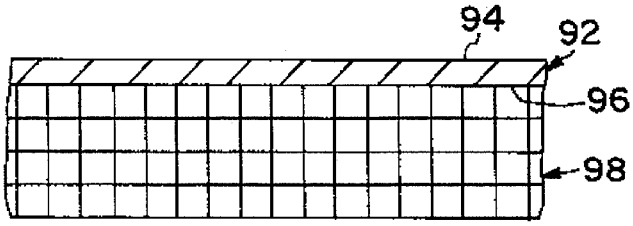
FIG. 21 is a sectional view of an energy absorbing single-hull assembly in accordance with the invention.

FIG. 21 provides an example of a single-hull ship in which a single hull 92 has opposite inner and outer surfaces 94 and 96 respectively. A non-ship structurally active energy absorbing arrangement is mounted on either of the surfaces 94 and 96, and in the example of FIG. 21 comprises a honeycomb sandwich foam material 98 mounted on the outer surface 96. However, the energy absorbing arrangement can comprise other arrangements such as those previously described. The honeycomb sandwich foam material 98 can be arranged at desired orientations relative to the single hull 92.

The presently disclosed embodiments are to be considered in all respects illustrative and not restrictive. The scope of the invention is indicated by the appendant claims, rather than the foregoing description. All changes which come within the meaning and range of equivalency of the claims are intended to be embraced therein.

What is claimed is:

1. In a ship having a hull assembly of an inner hull, an outer hull spaced apart from the inner hull, and a ship structurally active arrangement joining the inner hull and the outer hull together, the improvement comprising:

a plurality of non-ship structurally active, energy absorbing multi-cap cylinders, each extending between and having opposite ends coupled to the inner hull and the outer hull and comprising a stack of generally rounded, hollow caps, each of the caps having an upper portion of given diameter and a lower portion of diameter greater than the given diameter of the upper portion, the upper portion of each cap nesting within the lower portion of an immediately above cap except for a top cap at an upper end of the multi-cap cylinder.

2. The invention set forth in claim 1, wherein the upper portion has a relatively flat top with a plurality of corrugations extending upwardly therefrom.

* * * * *